US009489893B2

(12) United States Patent
Tan et al.

(10) Patent No.: US 9,489,893 B2
(45) Date of Patent: Nov. 8, 2016

(54) AMOLED PIXEL DRIVING CIRCUIT AND DRIVING METHOD THEREOF, AND ARRAY SUBSTRATE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Wen Tan, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan Province (CN)

( * ) Notice: Subject to any disclaimer, the term of this patent is extended or adjusted under 35 U.S.C. 154(b) by 13 days.

(21) Appl. No.: 14/436,268

(22) PCT Filed: Aug. 22, 2014

(86) PCT No.: PCT/CN2014/084998

§ 371 (c)(1),
(2) Date: Apr. 16, 2015

(87) PCT Pub. No.: WO2015/058582

PCT Pub. Date: Apr. 30, 2015

(65) Prior Publication Data

US 2016/0055797 A1 Feb. 25, 2016

(30) Foreign Application Priority Data

Oct. 25, 2013 (CN) ..... 2013 1 0512931

(51) Int. Cl.
*G09G 3/32* (2016.01)

(52) U.S. Cl.
CPC ..... *G09G 3/3258* (2013.01); *G09G 3/3208* (2013.01); *G09G 3/3225* (2013.01);
(Continued)

(58) Field of Classification Search
None
See application file for complete search history.

(56) References Cited

U.S. PATENT DOCUMENTS 7,173,590 B2 * 2/2007 Uchino ..... G09G 3/2011 345/104
8,111,217 B2 * 2/2012 Caligiore ..... G09G 3/3233 315/169.3

(Continued)

FOREIGN PATENT DOCUMENTS

CN 101609839 A 12/2009
CN 102376251 A 3/2012

(Continued)

OTHER PUBLICATIONS

International Preliminary Report on Patentability issued Apr. 26, 2016; PCT/CN2014/084998.

(Continued)

*Primary Examiner* — Dismery Mercedes
(74) *Attorney, Agent, or Firm* — Ladas & Parry LLP

(57) ABSTRACT

There are disclosed an AMOLED pixel driving circuit and driving method thereof, and array substrate. The AMOLED pixel driving circuit comprises a driving thin film transistor (T1), and a gate initial voltage writing module (T2) configured to write an initial voltage signal into a gate of the driving thin film transistor (T1), a first terminal of a storage capacitor (C1), and a second terminal of the coupling capacitor (C2); a data voltage writing module (T3) configured to write a data voltage signal into a source of the driving thin film transistor (T1); a saturation discharging module (T4) configured to connect or disconnect a first terminal of a coupling capacitor (C2) with or from the drain of the driving thin film transistor (T1); an initializing module (T5) configured to connect or disconnect the source of the driving thin film transistor (T1) with or from the second power supply (Vss); and a light emitting control module (T6) configured to connect or disconnect one terminal of the organic light emitting diode (D1) with or from a drain of the driving thin film transistor (T1); the storage capacitor (C1); the coupling capacitor (C2); and an organic light emitting diode (D1). The AMOLED pixel driving circuit and driving method thereof can realize the purpose of sub-threshold saturation turn-off and compensating for threshold voltage of the driving TFT.

18 Claims, 6 Drawing Sheets

(52) U.S. Cl.
CPC .... *G09G3/3233* (2013.01); *G09G 2300/0408* (2013.01); *G09G 2300/0819* (2013.01); *G09G 2300/0842* (2013.01); *G09G 2300/0852* (2013.01); *G09G 2300/0861* (2013.01)

(56) References Cited

U.S. PATENT DOCUMENTS

| | | | | |
|---|---|---|---|---|
| 8,378,938 | B2 * | 2/2013 | Nathan | G09G 3/3233 345/78 |
| 8,665,185 | B2 * | 3/2014 | Fan | G09G 3/3258 315/169.3 |
| 8,736,525 | B2 * | 5/2014 | Kawabe | G09G 3/3233 345/76 |
| 9,082,342 | B2 * | 7/2015 | Qi | G09G 3/32 |
| 9,230,479 | B2 * | 1/2016 | Tan | G09G 3/3233 |
| 2009/0309516 | A1 | 12/2009 | Kim | |
| 2010/0141645 | A1 * | 6/2010 | Choi | G09G 3/3233 345/214 |
| 2010/0201673 | A1 * | 8/2010 | Kim | G09G 3/3225 345/211 |
| 2011/0063266 | A1 | 3/2011 | Chung et al. | |
| 2012/0026143 | A1 | 2/2012 | Jang | |
| 2012/0038612 | A1 | 2/2012 | Chung et al. | |
| 2012/0242712 | A1 * | 9/2012 | Ko | G09G 3/3233 345/690 |
| 2013/0002615 | A1 | 1/2013 | Kang et al. | |
| 2013/0265215 | A1 * | 10/2013 | Liao | G09G 3/3233 345/82 |

FOREIGN PATENT DOCUMENTS

| | | | |
|---|---|---|---|
| CN | 102651197 | A | 8/2012 |
| CN | 103035201 | A | 4/2013 |
| KR | 101058110 | B1 | 8/2011 |

OTHER PUBLICATIONS

First Chinese Office Action dated Jul. 6, 2016; Appln. No. 201310512931.5.

* cited by examiner (a)

(b)

AMOLED PIXEL DRIVING CIRCUIT AND DRIVING METHOD THEREOF, AND ARRAY SUBSTRATE

TECHNICAL FIELD

The present disclosure relates to an active matrix organic light emitting diode (AMOLED) pixel driving circuit and driving method thereof, and an array substrate.

BACKGROUND

A pixel driving circuit of a traditional AMOLED is applicable to all types of transistors including a depletion type TFT. However, this pixel driving circuit does not have a threshold voltage compensation function, and thus cannot solve the problem of non-uniformity of the threshold voltage and non-uniformity of driving light emitting by an organic light emitting diode (OLED) caused by technique non-uniformity.

An oxide TFT is a development direction of a large-size AMOLED, because the oxide TFT has characteristics of depletion type, that is, the threshold voltage of N type is a negative value. The depletion type TFT adopts an AMOLED pixel driving circuit design of a traditional N type TFT. When compensating the threshold voltage by a diode connecting mode, since the threshold voltage is a negative value, TFT is turned off in advance for the source-drain voltage is zero before entering into sub-threshold saturation turn-off thereby losing the function of the threshold voltage compensation.

SUMMARY

In view of this, there is provided herein an AMOLED pixel driving circuit and driving method thereof and an array substrate, which can realize the purpose of sub-threshold saturation turn-off and compensating for the threshold voltage of the driving TFT.

An embodiment of the present disclosure provides an AMOLED pixel driving circuit comprising a driving thin film transistor, a storage capacitor, and an organic light emitting diode, it further comprises: a coupling capacitor connected to a first terminal of the storage capacitor; a gate initial voltage writing module configured to write an initial voltage signal into a gate of the driving thin film transistor, the first terminal of the storage capacitor, and a second terminal of the coupling capacitor; a data voltage writing module configured to write a data voltage signal into a source of the driving thin film transistor; an initializing module configured to initialize a voltage at the source of the driving thin film transistor; a light emitting control module configured to control one terminal of the organic light emitting diode to be connected to a drain of the driving thin film transistor; a saturation discharging module connected between a first terminal of the coupling capacitor and the drain of the driving thin film transistor.

As an example, the gate initial voltage writing module comprise a second thin film transistor, whose source is connected to the first terminal of the storage capacitor, the second terminal of the coupling capacitor and the gate of the driving thin film transistor being connected, gate is connected to a gate signal of a previous row, and drain is connected to an initial voltage signal terminal.

As an example, the data voltage writing module comprises a third thin film transistor, whose gate is connected to a gate signal of a current row, drain is connected to the source of the driving thin film transistor, and source is connected to a data voltage signal terminal.

As an example, the saturation discharging module comprises a fourth thin film transistor, whose drain is connected to the first terminal of the coupling capacitor, gate is connected to a first control signal line, and source is connected to the drain of the driving thin film transistor.

As an example, the initializing module comprises a fifth thin film transistor, whose source is connected to the source of the driving thin film transistor, gate is connected to a second control signal line, and drain and the terminal of the storage capacitor are jointly connected to a second power supply.

As an example, the light-emitting control module comprises a sixth thin film transistor, whose source is connected to the drain of the driving thin film transistor, gate is connected to the second control signal line, and drain is connected to the one terminal of the organic light emitting diode whose other terminal is connected to a first power supply.

Alternatively, the driving thin film transistor, the second thin film transistor, the third thin film transistor, the fourth thin film transistor, the fifth thin film transistor, and the sixth thin film transistor are N type depletion thin film transistors.

Alternatively, the initial voltage signal is a data voltage signal.

An embodiment of the present disclosure further provides an array substrate comprising the pixel driving circuit.

An embodiment of the present disclosure further provides a driving method of an AMOLED pixel driving circuit. The pixel driving circuit comprises: a driving thin film transistor, a gate initial voltage writing module, a data voltage writing module, a saturation discharging module, an initializing module, a light emitting control module, a storage capacitor, a coupling capacitor, and an organic light emitting diode. The driving method comprises:

in an initializing phase:

writing an initial voltage signal into a gate of the driving thin film transistor, a first terminal of the storage capacitor and a second terminal of the coupling capacitor by the gate initialization voltage writing module; disconnecting a data voltage signal terminal from a source of the driving thin film transistor by the data voltage writing module; connecting the source of the driving thin film transistor with a second power supply by the initializing module; charging a second terminal of the storage capacitor by the second power supply; connecting one terminal of the organic light emitting diode with a drain of the driving thin film transistor by the light emitting control module; connecting a first terminal of the coupling capacitor with the drain of the driving thin film transistor by the saturation discharging module; and charging the first terminal of the coupling capacitor through the organic light emitting diode by a first power supply;

in a threshold voltage compensating and data voltage writing phase:

disconnecting the initial voltage signal terminal from the gate of the driving thin film transistor, the first terminal of the storage capacitor and the second terminal of coupling capacitor by the gate initial voltage writing module; connecting the data voltage signal terminal with the source of the driving thin film transistor by the data voltage writing module to write a data voltage signal into the source of the driving thin film transistor, disconnecting the source of the driving thin film transistor from the second power supply by the initializing module; disconnecting the one terminal of the organic light emitting diode from the drain of the driving thin film transistor by the light emitting control module;

connecting the first terminal of the coupling capacitor with the drain of the driving thin film transistor by the saturation discharging module; and discharging the storage capacitor and the coupling capacitor through the driving thin film transistor;

in a light emitting phase:

disconnecting the initial voltage signal terminal from the gate of the driving thin film transistor, the first terminal of the storage capacitor and the second terminal of the coupling capacitor by the gate initial voltage writing module; disconnecting the data voltage signal terminal from the source of the driving thin film transistor by the data voltage writing module; connecting the source of the driving thin film transistor with the second power supply by the initializing module; connecting the one terminal of the organic light emitting diode with the drain of the driving thin film transistor by the light emitting control module; disconnecting the first terminal of the coupling capacitor from the drain of the driving thin film transistor by the saturation discharging module; and providing a driving current for the organic light emitting diode by the driving thin film transistor As an example, the gate initial voltage writing module can comprise a second thin film transistor. The data voltage writing module can comprise a third thin film transistor. The saturation discharging module can comprise a fourth thin film transistor. The initializing module can comprise a fifth thin film transistor. The light emitting control module can comprise a sixth thin film transistor. The driving method comprises:

in the initializing phase:

turning on the second thin film transistor, the fourth thin film transistor, the fifth thin film transistor and the sixth thin film transistor, and turning off the third thin film transistor; writing the initial voltage signal into the gate of the driving thin film transistor, the first terminal of the storage capacitor and the second terminal of the coupling capacitor; charging the second terminal of the storage capacitor by the second power supply; and charging the first terminal of the coupling capacitor by the first power supply;

in the threshold voltage compensating and data voltage writing phase:

turning on the third thin film transistor and the fourth thin film transistor, and turning off the second thin film transistor, the fifth thin film transistor and the sixth thin film transistor; writing the data voltage signal into the source of the driving thin film transistor; and discharging the storage capacitor and the coupling capacitor through the driving thin film transistor;

in the light emitting phase:

turning on the fifth transistor and the sixth thin film transistor, and turning off the second thin film transistor, the third thin film transistor and the fourth thin film transistor; and providing the driving current for the light emitting diode by the driving thin film transistor.

According to the AMOLED pixel driving circuit and driving method, and the array substrate provided in the embodiments of the present disclosure, the pixel driving circuit comprises the driving thin film transistor, the gate initial voltage writing module, the data voltage writing module, the saturation discharging module, the initializing module, the light emitting control module, the storage capacitor, the coupling capacitor and the organic light emitting diode. The gate initial voltage writing module is configured to write the initial voltage signal into the gate of the driving thin film transistor, the first terminal of the storage capacitor, the second terminal of the coupling capacitor. The data voltage writing module is configured to write the data voltage signal into the source of the driving thin film transistor. The initializing module is configured to connect or disconnect the source of the driving thin film transistor with or from the second power supply. The light emitting control module is configured to connect or disconnect the one terminal of the organic light emitting diode with or from the drain of the driving thin film transistor. The saturation discharging module is configured to connect or disconnect the first terminal of the coupling capacitor with or from the drain of the driving transistor. The embodiments of the present disclosure arrange one coupling capacitor between a discharging node and the gate of the driving TFT to change the precharging mode, so as to charge the discharging node to a high level $V_{DD}$, and charge the gate of the driving TFT to $V_{DATA}$ or $V_{INI}$, and at the same time reduce the voltage at the gate of the driving TFT through the coupling capacitor in the discharging process of the discharging node, so that the voltage at the gate of the driving TFT is lower than the voltage at the source of the driving TFT, thereby realizing the sub-threshold saturation turn-off and compensating for the threshold voltage of the driving TFT.

BRIEF DESCRITION OF THE DRAWINGS

FIG. 3(*b*) is a schematic diagram of a threshold voltage compensation principle of a driving TFT as shown in FIG. 3(*a*);

FIG. 4(*b*) is a schematic diagram of a threshold voltage compensation failure of a depletion type TFT of the circuit as shown in FIG. 3(*a*);

FIG. 8(*b*) is an operating principle diagram of an AMOLED pixel driving circuit according to an embodiment of the present disclosure in a threshold voltage compensating and data voltage writing phase;

FIG. 8(*c*) is an operating principle diagram of an AMOLED pixel driving circuit according to an embodiment of the present disclosure in an OLED light emitting phase.

DETAILED DESCRITION

Figure 1:
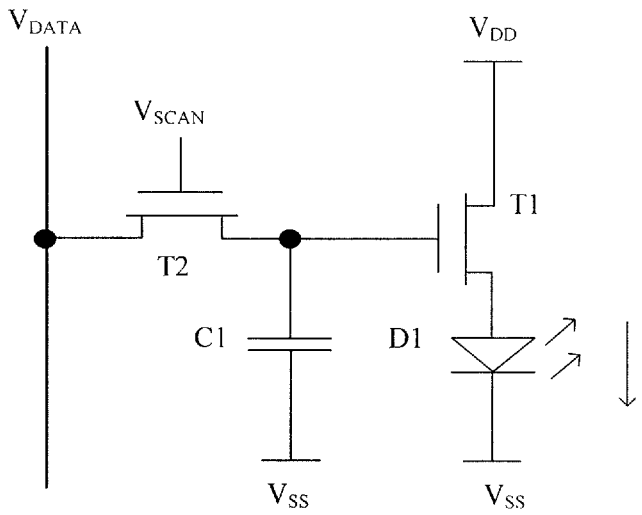
FIG. 1 is a structure of a basic pixel driving circuit of a traditional AMOLED.
Figure 1:
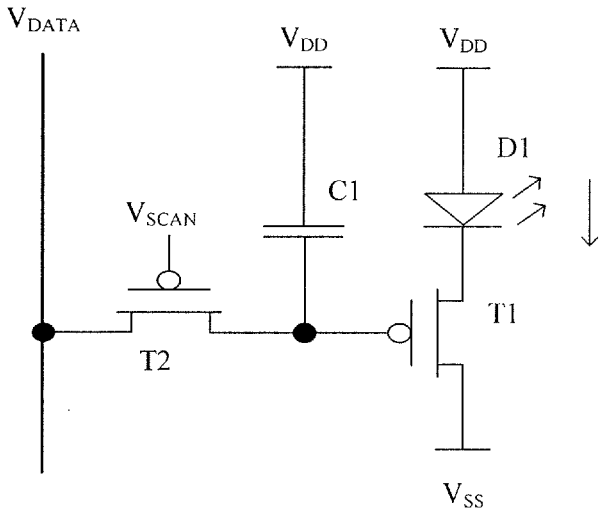

FIG. 1 shows a basic structure of pixel driving circuit of a traditional AMOLED. There represents in FIG. 1(*a*) an AMOLED pixel driving circuit composed of N type thin film transistors (TFT), comprising two N types of TFTs, T1 and T2, a light emitting diode D1 and a storage capacitor C1.

There represents in FIG. 1(*b*) an AMOLED pixel driving circuit composed of P type TFTs, comprising: two P type TFTs, T1 and T2, a light emitting diode D1 and a storage capacitor C1. The above circuit is applicable to all types of transistors including a depletion type TFT. However, this pixel driving circuit does not have a threshold voltage compensation function, and thus cannot solve the problem of non-uniformity of the threshold voltage and non-uniformity of driving light emitting by an organic light emitting diode (OLED) caused by technique non-uniformity.

Figure 2:
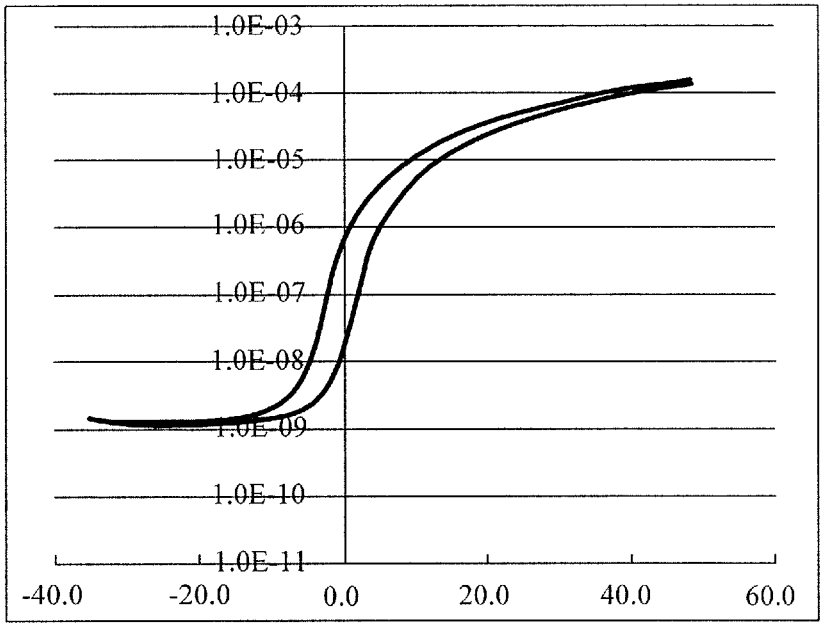
FIG. 2 is an Ids-Vgs characteristic curve diagram of a N type deletion TFT.

At present, an oxide TFT device mostly has a characteristic of depletion type. FIG. 2 is an Ids-Vgs characteristic curve diagram of N type deletion TFT. It can be seen from FIG. 2 that the most importance feature of the N type depletion TFT is that a threshold voltage $V_{TH}$ is less than 0, the horizontal coordinate is voltage, and the vertical coordinate is current.

Firstly, a known AMOLED pixel driving circuit having threshold voltage compensation will be briefly introduced below.

Figure 3A:
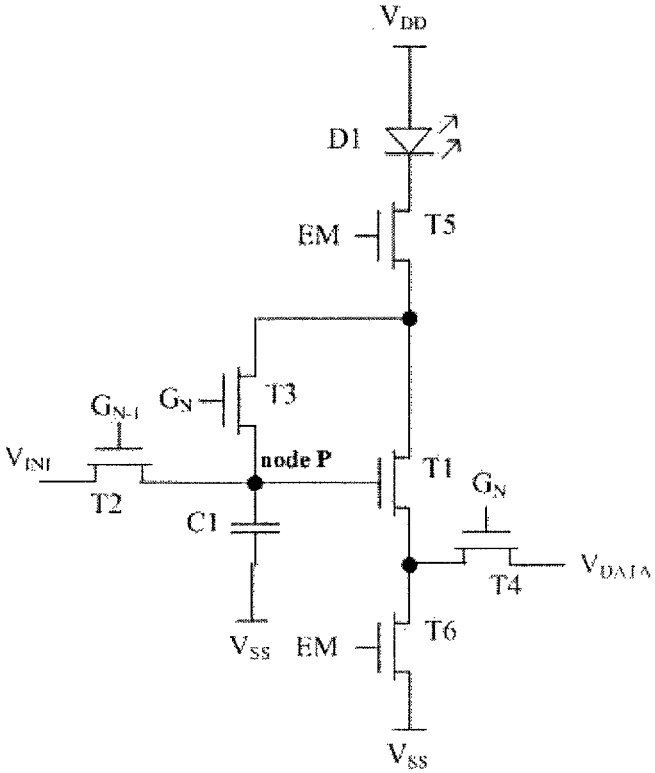
FIG. 3(*a*) is a schematic diagram of a structure of a known AMOLED pixel driving circuit having threshold voltage compensation.
Figure 3B:
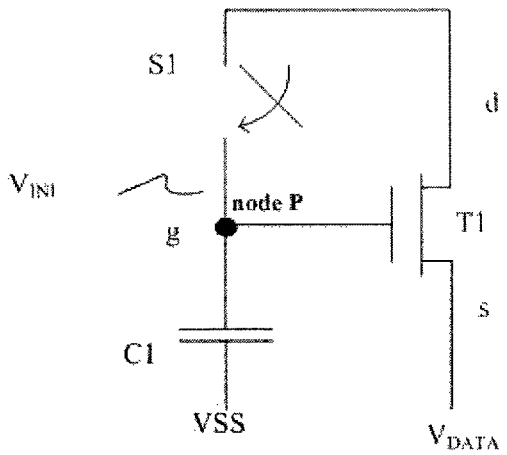

FIG. 3(*a*) is a schematic diagram of a structure of a known AMOLED pixel driving circuit having threshold voltage compensation. FIG. 3(*b*) is a schematic diagram of a threshold voltage compensation principle of the driving TFT as shown in FIG. 3(*a*). In a voltage programming phase, as shown in FIG. 3(*b*), firstly, T5 and T6 are turned off, a connection of a driving TFT T1 with a high level $V_{DD}$ and a low level $V_{SS}$ is cut off, one terminal of a storage capacitor C1 is connected to a gate of the driving TFT T1, T2 is turned on, and T3 and T4 are turned off, that is, the gate of T1 is charged to an initial voltage signal $V_{INI}$. Then, T2 is turned off, T3 and T4 are turned on, and the gate of the driving TFT T1 is connected with the drain thereof to form a diode connecting mode to discharge, i.e., finally discharging the voltage across the storage capacitor C1 (i.e., the voltage between the gate and source of T1) to a sub-threshold turn-on state $V_{DATA}+V_{TH}$ of the driving TFT T1, where $V_{DATA}$ is a data voltage signal.

Figure 4A:
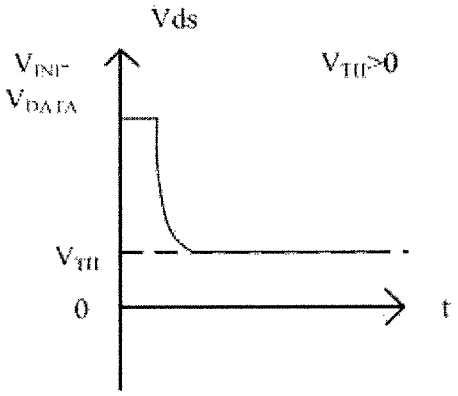
FIG. 4(*a*) is a schematic diagram of a threshold voltage of an enhancement type TFT of the circuit as shown in FIG. 3(*a*)
Figure 4B:
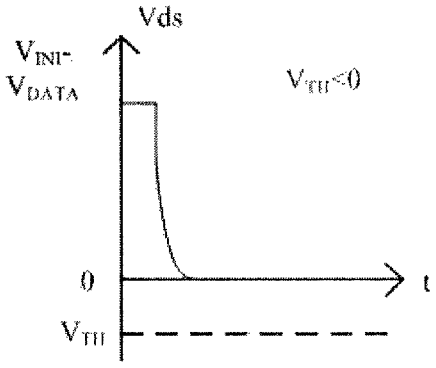

When the driving TFT T1 has a characteristic of a general enhancement type, the threshold voltage is positive. As shown in FIG. 4(*a*), the voltage across the storage capacitor C1 (i.e., the voltage between the gate and source of T1) can be normally discharged to $V_{DATA}+V_{TH}$, to realize threshold voltage compensation. However, when the driving TFT has a characteristic of a depletion type, the threshold voltage V-H is negative. As shown in FIG. 4(*b*), when the voltage at the two terminals of the storage capacitor C1 is discharged through the driving TFT T1 connected as a diode, and a source-drain voltage of the driving TFT T1 becomes zero and the driving TFT T1 is turned off, it still does not discharge to achieve the sub-threshold turn-on state, that is, the voltage at the two terminals of the storage capacitor C1 is 0, instead of $V_{TH}$ ($V_{TH}<0$). Therefore, the pixel driving circuit losses the threshold voltage compensation function.

A basic concept of embodiments of the present disclosure is to arrange a coupling capacitor between a discharging node and the gate of the driving TFT T1 to change the precharging mode, so as to charge the discharging node to a high level $V_{DD}$, and charge the gate of the driving TFT to $V_{DATA}$ or $V_{INI}$, and at the same time to reduce the voltage at the gate of the driving TFT through the coupling capacitor in the discharging process of the discharging node, so that the voltage at the gate of the driving TFT is lower than the voltage at the source of the driving TFT, thereby realizing the sub-threshold saturation turn-off to compensate for the threshold voltage of the driving TFT T1.

Herein, the sub-threshold saturation turn-off state refers to a critical state between turn-on and turn-off, i.e., referring to the state of $V_{GS}=V_{TH}$, wherein $V_{GS}$ is voltage between the gate and source of the driving TFT.

The embodiments of the present disclosure will be further described in details by combining with figures.

Figure 5:
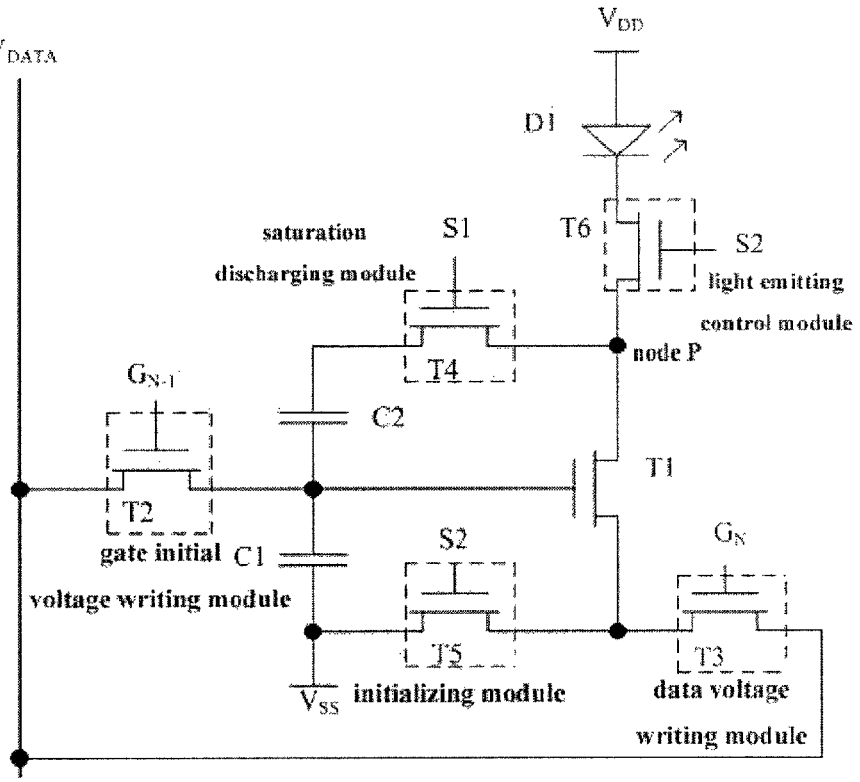
FIG. 5 is a structure diagram of an AMOLED pixel driving circuit of a depletion type TFT according to a first embodiment of the present disclosure.

FIG. 5 is a structure diagram of an AMOLED pixel driving circuit of a depletion type TFT according to a first embodiment of the present disclosure. As shown in FIG. 5, the AMOLED pixel driving circuit comprises: a driving thin film transistor T1, a gate initial voltage writing module, a data voltage writing module, a saturation discharging module, an initializing module, and a light emitting control module. In this exemplary embodiment, the gate initial voltage writing module comprises a second thin film transistor T2, which is a gate initial voltage writing TFT. The data voltage writing module comprises a third thin film transistor T3, which is a data voltage writing TFT. The saturation discharging module comprises a fourth thin film transistor T4, which is a saturation discharging TFT. The initializing module comprises a fifth thin film transistor T5, which is an initializing TFT. The light emitting control module comprises a sixth thin film transistor T6, which is a light emitting control TFT. The driving thin film transistor T1 and the thin film transistor T2-T6 are N type TFTs having a characteristic of depletion. This circuit further comprises a storage capacitor C1, a coupling capacitor C2, and an organic light emitting diode D1. As shown in FIG. 5, $G_{N-1}$ is a gate signal of a previous row, $G_N$ is a gate signal of a current row, S1 is a first control signal, S2 is a second control signal, $V_{DD}$ is a first power supply, and $V_{SS}$ is a second power supply. A discharging node of the embodiment of the present disclosure is a node P in FIG. 5.

As an example, a source is connected to a first terminal of the storage capacitor C1, a second terminal of the coupling capacitor C2 and a gate of the driving thin film transistor T1, a gate of the thin film transistor T2*f* is connected to the gate signal $G_{N-1}$ of the previous row, and a drain thereof is connected to an initial voltage signal terminal. The initial voltage signal terminal in the first embodiment of the present disclosure is a data voltage signal terminal $V_{DATA}$.

A gate of the thin film transistor T3 is connected to the gate signal $G_N$ of the current row, a drain thereof is connected to a source of the driving thin film transistor T1, and a source thereof is connected to the data voltage signal terminal $V_{DATA}$.

A drain of the thin film transistor T4 is connected to a first terminal of the coupling capacitor C2, a gate thereof is connected to the first control signal line S1, and a source thereof is connected to a drain of the driving thin film transistor T1.

A source of the thin film transistor T5 is connected to the source of the driving thin film transistor T1, a gate thereof is connected to the second control signal line S2, and a drain thereof and a second terminal of the storage capacitor C1 are jointly connected to the second power supply $V_{SS}$.

A source of the thin film transistor T6 is connected to the drain of the driving thin film transistor T1, a gate thereof is connected to the second control signal S2, a drain thereof is connected to one terminal of the organic light emitting diode D1, and the other terminal of the organic light diode D1 is connected to the first power supply $V_{DD}$.

Figure 6:
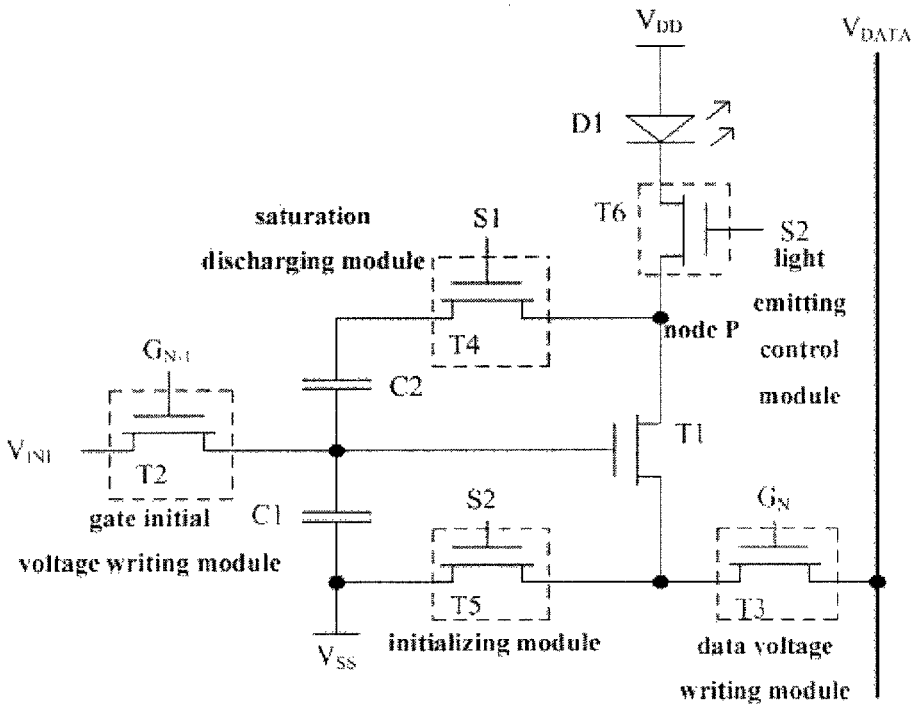
FIG. 6 is a structure diagram of an AMOLED pixel driving circuit of a depletion type TFT according to a second embodiment of the present disclosure.

FIG. 6 is a structure diagram of an AMOLED pixel driving circuit of a depletion type TFT according to a second embodiment of the present disclosure. As shown in FIG. 6, the circuit comprises: a driving thin film transistor T1, a gate initial voltage writing module, a data voltage writing module, a saturation discharging module, an initializing module, and a light emitting control module. In this embodiment, the gate initial voltage writing module comprises a second thin film transistor T2, which is a gate initial voltage writing TFT. The data voltage writing module comprises a third thin film transistor T3, which is a data voltage writing TFT. The saturation discharging module comprises a fourth thin film transistor T4, which is a saturation discharging TFT. The initializing module comprises a fifth thin film transistor, which is an initializing TFT. The light emitting control module comprises a sixth thin film transistor T6, which is a light emitting control TFT. The driving thin film transistor T1 and the thin film transistor T2~T6 are N type TFTs having a characteristic of depletion. This circuit further comprises a storage capacitor C1, a coupling capacitor C2, and an organic light emitting diode D1. As shown in FIG. 6, $G_{N-1}$ is a gate signal of a previous row, $G_N$ is a gate signal of a current row, S1 is a first control signal, S2 is a second control signal, $V_{SS}$ is a second power supply, and $V_{DD}$ is a first power supply. A node P in FIG. 6 is a discharging node of the embodiment of the present disclosure.

The present embodiment differs from the first embodiment only in: the drain of the thin film transistor T2 is connected to the initial voltage signal terminal $V_{INI}$. The connecting relationship of other parts is completely the same, and thus no further description is given herein.

The embodiments of the present disclosure further provide a driving method of an AMOLED pixel driving circuit. The pixel driving circuit comprises: a driving thin film transistor, a gate initial voltage writing module, a data voltage writing module, a saturation discharging module, an initializing module, a light emitting control module, a storage capacitor, a coupling capacitor, and an organic light emitting diode. The driving method comprises following operation processes:

in an initializing phase:

writing an initial voltage signal into a gate of the driving thin film transistor T1, a first terminal of the storage capacitor C1 and a second terminal of the coupling capacitor C2 by the gate initial voltage writing module; disconnecting a data voltage signal terminal from a source of the driving thin film transistor T1 by the data voltage writing module; connecting the source of the driving thin film transistor T1 with a second power supply $V_{SS}$ by the initializing module; charging a second terminal of the storage capacitor C1 by the second power supply; connecting one terminal of the organic light emitting diode D1 with a drain of the driving thin film transistor T1 by the light emitting control module; connecting a first terminal of the coupling capacitor C2 with the drain of the driving thin film transistor T1 by the saturation discharging module; and charging the first terminal of the coupling capacitor through the organic light emitting diode D1 by a first power supply $V_{DD}$;

in a threshold voltage compensating and data voltage writing phase:

disconnecting the initial voltage signal terminal from the gate of the driving thin film transistor T1, the first terminal of the storage capacitor C1 and the second terminal of coupling capacitor C2 by the gate initial voltage writing module; connecting the data voltage signal terminal with the source of the driving thin film transistor T1 by the data voltage writing module to write a data voltage signal into the source of the driving thin film transistor T1; disconnecting the source of the driving thin film transistor T1 from the second power supply $V_{SS}$ by the initializing module; disconnecting the one terminal of the organic light emitting diode D1 from the drain of the driving thin film transistor T1 by the light emitting control module; connecting the first terminal of the coupling capacitor C2 with the drain of the driving thin film transistor T1 by the saturation discharging module; and discharging the storage capacitor C1 and the coupling capacitor C2 through the driving thin film transistor T1;

in a light emitting phase:

disconnecting the initial voltage signal terminal from the gate of the driving thin film transistor T1, the first terminal of the storage capacitor C1 and the second terminal of the coupling capacitor C2 by the gate initial voltage writing module; disconnecting the data voltage signal terminal from the source of the driving thin film transistor T1 by the data voltage writing module; connecting the source of the driving thin film transistor T1 with the second power supply $V_{SS}$ by the initializing module; connecting the one terminal of the organic light emitting diode D1 with the drain of the driving thin film transistor T1 by the light emitting control module; disconnecting the first terminal of the coupling capacitor C2 from the drain of the driving thin film transistor T1 by the saturation discharging module; and providing a driving current for the organic light emitting diode D1 by the driving thin film transistor.

For example, the gate initial voltage writing module can comprise a second thin film transistor. The data voltage writing module can comprise a third thin film transistor. The saturation discharging module can comprise a fourth thin film transistor. The initializing module can comprise a fifth thin film transistor. The light emitting control module can comprise a sixth thin film transistor. In this case, the operation processes of the driving method are as follows:

in the initializing phase:

turning on the second thin film transistor, the fourth thin film transistor, the fifth thin film transistor and the sixth thin film transistor, and turning off the third thin film transistor, writing the initial voltage signal into the gate of the driving thin film transistor T1, the first terminal of the storage capacitor and the second terminal of the coupling capacitor, charging the second terminal of the storage capacitor by the second power supply; and charging the first terminal of the coupling capacitor by the first power supply;

in the threshold voltage compensating and data voltage writing phase:

turning on the third thin film transistor and the fourth thin film transistor, and turning off the second thin film transistor, the fifth thin film transistor and the sixth thin film transistor; writing the data voltage signal into the source of the driving thin film transistor T1, and discharging the storage capacitor and the coupling capacitor through the driving thin film transistor T1;

in the light emitting phase:

turning on the fifth transistor and the sixth thin film transistor, and turning off the second thin film transistor, the third thin film transistor and the fourth thin film transistor; and providing the driving current for the light emitting diode by the driving thin film transistor T1.

Figure 7:
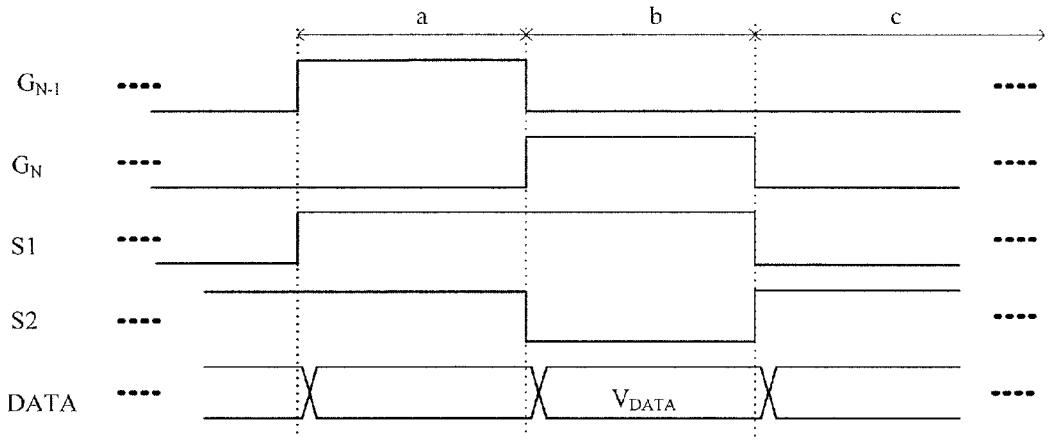
FIG. 7 is an operating timing diagram of an AMOLED pixel driving circuit according to an embodiment of the present disclosure.

The driving method will be described in detail by combining with a particular embodiment below. FIG. 7 is an operating timing diagram of an AMOLED pixel driving circuit according to the embodiment of the present disclosure, wherein a shown in the figure is the initializing phase, b shown in the figure is the threshold voltage compensation and data voltage writing phase, and c shown in the figure is the light emitting phase.

Figure 8A:
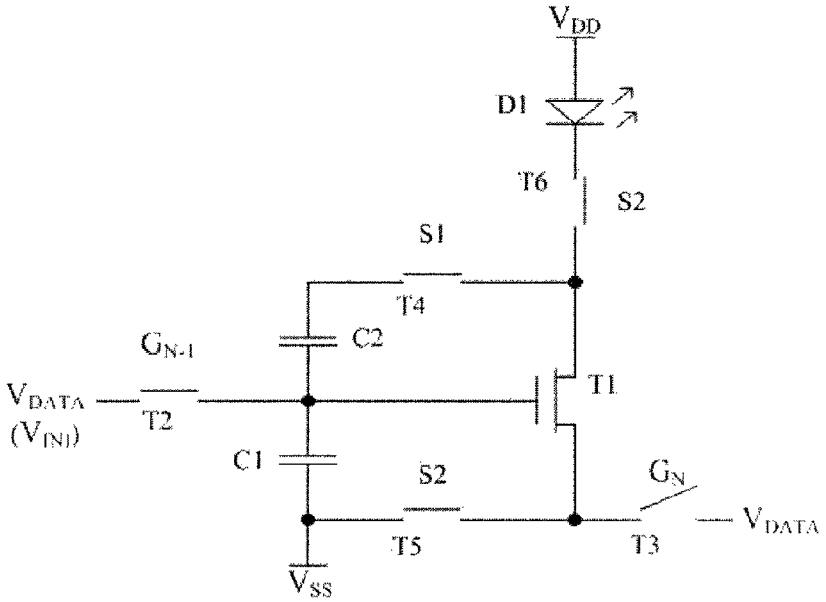
FIG. 8(*a*) is an operating principle diagram of an AMOLED pixel driving circuit according to an embodiment of the present disclosure in an initializing stage.
Figure 8:
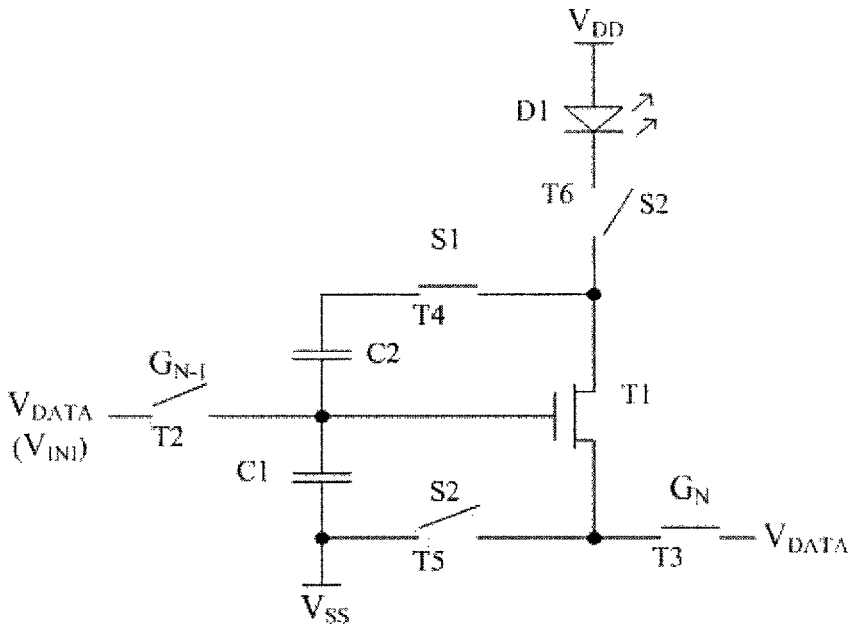
Figure 8C:
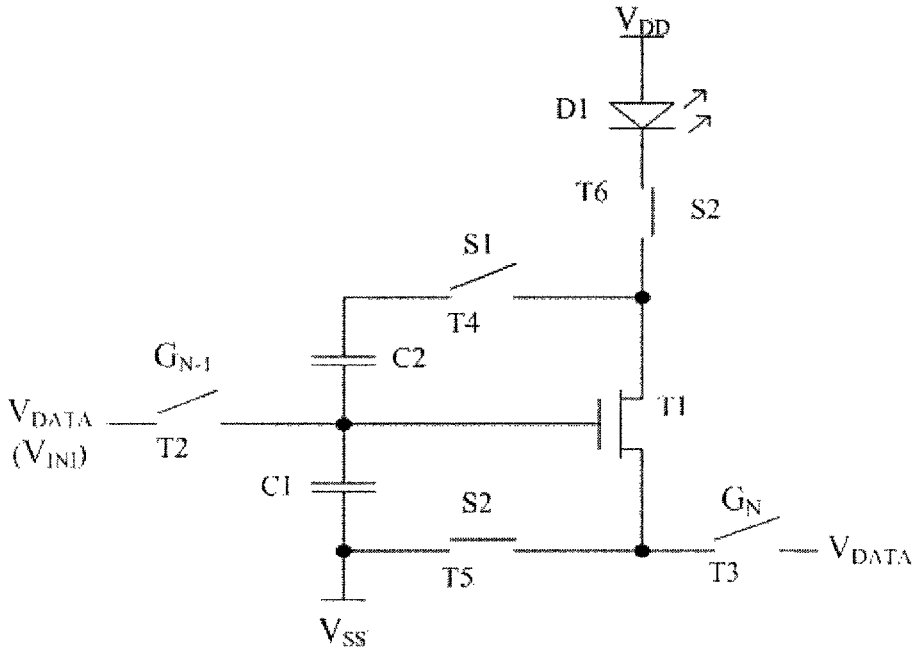

In the initialization phase a: as shown in FIG. 8(*a*), $G_{N-1}$, S1 and S2 are at a high level, and $G_N$ is at a low level. DATA shown in the figure is the data voltage $V_{DATA}$. By taking the initial voltage signal being $V_{DATA}$ as an example, $V_{SS}<V_{DATA}<V_{DD}$, T2, T4, T5 and T6 are turned on, and T3 is turned off. The first terminal of the storage capacitor C1 that is connected to the gate of T1 is charged to be $V_{DATA}$, and the second terminal thereof is charged to be $V_{SS}$, then a voltage difference between the two terminals of the storage capacitor C1 is VDATA−VSS. The first terminal of the coupling capacitor C2 is $V_{DD}$, and the second terminal thereof is $V_{DATA}$, then a voltage difference between the two terminals of the coupling capacitor C2 is $V_{DD}-V_{DATA}$.

In the threshold voltage compensating and data voltage writing phase b: as shown in FIG. 8(*b*), $G_{N-1}$ and S2 are at the low level, S1 and $G_N$ are at the high level, DATA is the data voltage $V_{DATA}$. By taking the initial voltage signal being $V_{DATA}$ as an example, $V_{SS}<V_{DATA}<V_{DD}$, T3 and T4 are turned on, and T2, T5 and T6 are turned off. Voltages initially stored on the C1 and C2 are discharged through T1, i.e., the drain of T1 drops from the high level $V_{DD}$ by discharging. Due to the coupling effect of C2, the gate of T1 also drops from $V_{DATA}$. If the voltage change of the drain of T1 is ΔV, then the voltage change of the gate of T1 is [C2/(C1+C2)]*ΔV.

The drain of T1 is discharged until the voltage at the gate of T1 $V_{GS}\leq V_{TH}$, i.e., $V_{DATA}-V_{DATA}-[C2/(C1+C2)]*\Delta V=V_{TH}$, at the same time, in order to ensure that T1 will not be turned off in advance due to the source-drain voltage being zero such that threshold voltage compensation is lost, then it needs to satisfy the relational expression of $V_{DD}-V_{DATA}-\Delta V>0$. Therefore, the threshold voltage compensation can be realized only if the condition of $V_{DD}-V_{DATA}>[(C1+C2)/C2]*V_{TH}$ is satisfied. As such, the first terminal of the storage capacitor C1 that is connected to the gate of T1 has a level of $V_{DATA}+V_{TH}$, and the second terminal thereof has a level $V_{SS}$, i.e., the voltage difference between the two terminals of the storage capacitor C1 is: $V_{DATA}-V_{SS}+V_{TH}$.

In the light emitting phase c: as shown in FIG. 8(*c*), S2 is at the high level, S1, $G_N$ and $G_{N-1}$ are at the low level, T5 and T6 are turned on, T2, T3, and T4 are turned off, the gate-source voltage of T1 $V_{GS}=V_{DATA}-V_{SS}+V_{TH}$. Thus, the drain current of T1 is: $I_{DS}=0.5\ k*(V_{DATA}-V_{SS}+V_{TH}-V_{TH})^2=0.5\ k*(V_{DATA}-V_{SS})^2$. D1 emits light to display under the driving of the drain current of T1. At the same time, the drain current of T1 is independent of the threshold voltage, which can implement the compensating of the threshold voltage of T1. Herein, k is a current coefficient of the thin film transistor.

In the case of the initial voltage signal being $V_{INI}$, $V_{SS}<V_{INI}<V_{DD}$, the compensating principle of the threshold voltage of T1 is similar to the case of the initial voltage signal being $V_{DATA}$. In the threshold voltage compensating and writing phase, the drain of T1 is discharged until the voltage at the gate of T1 $V_{GS}\leq V_{TH}$, i.e., $V_{INI}-V_{DATA}-[C2/(C1+C2)]*\Delta V=V_{TH}$. At the same time, in order to ensure that T1 will not be turned off in advance due to the source-drain voltage being zero, such that threshold voltage compensation is lost, then it needs to satisfy the relational expression of $V_{DD}-V_{DATA}-\Delta V>0$. Therefore, the threshold voltage compensation can be realized only if the condition of $V_{DD}-V_{DATA}>[(C1+C2)/C2]*(V_{INI}-V_{DATA}-V_{TH})$ is satisfied.

An embodiment of the present disclosure further provides an array substrate comprising a plurality of data lines arranged in an extended way along a column, a plurality of first scanning lines, second scanning lines and signal control lines arranged in an extended way along a row, and a plurality of pixels disposed at a crossing position of the data lines and the scanning lines in a matrix form. The pixels comprise the pixel driving circuit as described above.

An embodiment of the present disclosure further provides a display panel comprising the array substrate as described above.

An embodiment of the present disclosure further provides a display device comprising the display panel as described above. The display device may be a display apparatus such as an electronic paper, a mobile phone, a digital photo frame and so on.

The above descriptions are just exemplary embodiments of the present disclosure, but not used for limiting the protection scope of the present disclosure. Those skilled in the art can make various improvements and modifications to the embodiments of the present disclosure without departing from the substance and scope of the present disclosure. The protection scope of the present disclosure is subject to the protection scope of the claims.

The present application claims the priority of Chinese patent Application No. 201310512931.5 filed on Oct. 25, 2013, entire content of which is incorporated herein as part of the present disclosure by reference.

What is claimed is:

1. An AMOLED pixel driving circuit comprising a driving thin film transistor, a storage capacitor, and an organic light emitting diode, wherein it further comprises:

a coupling capacitor connected to a first terminal of the storage capacitor;

a gate initial voltage writing module configured to write an initial voltage signal into a gate of the driving thin film transistor, the first terminal of the storage capacitor, and a second terminal of the coupling capacitor;

a data voltage writing module configured to write a data voltage signal into a source of the driving thin film transistor;

an initializing module configured to initialize a voltage at the source of the driving thin film transistor;

a light emitting control module configured to control one terminal of the organic light emitting diode to be connected to a drain of the driving thin film transistor; and a saturation discharging module connected between a first terminal of the coupling capacitor and the drain of the driving thin film transistor.

2. The pixel driving circuit according to claim 1, wherein the gate initial voltage writing module comprise a second thin film transistor, whose source is connected to the first terminal of the storage capacitor, the second terminal of the coupling capacitor and the gate of the driving thin film transistor, gate is connected to a gate signal of a previous row, and drain is connected to an initial voltage signal terminal.

3. The pixel driving circuit according to claim 2, wherein the data voltage writing module comprises a third thin film transistor, whose gate is connected to a gate signal of a current row, drain is connected to the source of the driving thin film transistor, and source is connected to a data voltage signal terminal.

4. The pixel driving circuit according to claim 3, wherein the saturation discharging module comprises a fourth thin film transistor, whose drain is connected to the first terminal of the coupling capacitor, gate is connected to a first control signal line, and source is connected to the drain of the driving thin film transistor.

5. The pixel driving circuit according to claim 4, wherein the initializing module comprises a fifth thin film transistor, whose source is connected to the source of the driving thin film transistor, gate is connected to a second control signal line, and drain and the terminal of the storage capacitor are jointly connected to a second power supply.

6. The pixel driving circuit according to claim 5, wherein the light-emitting control module comprises a sixth thin film transistor, whose source is connected to the drain of the driving thin film transistor, gate is connected to the second control signal line, and drain is connected to the one terminal of the organic light emitting diode whose other terminal is connected to a first power supply.

7. The pixel driving circuit according to claim 6, wherein the driving thin film transistor, the second thin film transistor, the third thin film transistor, the fourth thin film transistor, the fifth thin film transistor, and the sixth thin film transistor are N type depletion thin film transistors.

8. The pixel driving circuit according to claim 1, wherein the initial voltage signal is a data voltage signal.

9. An array substrate comprising the pixel driving circuit according to claim 1.

10. The array substrate according to claim 9, wherein the gate initial voltage writing module comprise a second thin film transistor, whose source is connected to the first terminal of the storage capacitor, the second terminal of the coupling capacitor and the gate of the driving thin film transistor, gate is connected to a gate signal of a previous row, and drain is connected to an initial voltage signal terminal.

11. The array substrate according to claim 10, wherein the data voltage writing module comprises a third thin film transistor, whose gate is connected to a gate signal of a current row, drain is connected to the source of the driving thin film transistor, and source is connected to a data voltage signal terminal.

12. The array substrate according to claim 11, wherein the saturation discharging module comprises a fourth thin film transistor, whose drain is connected to the first terminal of the coupling capacitor, gate is connected to a first control signal line, and source is connected to the drain of the driving thin film transistor.

13. The array substrate according to claim 12, wherein the initializing module comprises a fifth thin film transistor, whose source is connected to the source of the driving thin film transistor, gate is connected to a second control signal line, and drain and the terminal of the storage capacitor are jointly connected to a second power supply.

14. The array substrate according to claim 13, wherein the light-emitting control module comprises a sixth thin film transistor, whose source is connected to the drain of the driving thin film transistor, gate is connected to the second control signal line, and drain is connected to the one terminal of the organic light emitting diode whose other terminal is connected to a first power supply.

15. The array substrate according to claim 14, wherein the driving thin film transistor, the second thin film transistor, the third thin film transistor, the fourth thin film transistor, the fifth thin film transistor, and the sixth thin film transistor are N type depletion thin film transistors.

16. The array substrate according to claim 9, wherein the initial voltage signal is a data voltage signal.

17. A driving method of an AMOLED pixel driving circuit, wherein the pixel driving circuit comprises: a driving thin film transistor, a gate initial voltage writing module, a data voltage writing module, a saturation discharging module, an initializing module, a light emitting control module, a storage capacitor, a coupling capacitor, and an organic light emitting diode, the driving method comprising steps of:

in an initializing phase:

writing an initial voltage signal into a gate of the driving thin film transistor, a first terminal of the storage capacitor and a second terminal of the coupling capacitor by the gate initial voltage writing module; disconnecting a data voltage signal terminal from a source of the driving thin film transistor by the data voltage writing module; connecting the source of the driving thin film transistor with a second power supply by the initializing module; charging a second terminal of the storage capacitor by the second power supply; connecting one terminal of the organic light emitting diode with a drain of the driving thin film transistor by the light emitting control module; connecting a first terminal of the coupling capacitor with the drain of the driving thin film transistor by the saturation discharging module; and charging the first terminal of the coupling capacitor through the organic light emitting diode by a first power supply;

in a threshold voltage compensating and data voltage writing phase:

disconnecting the initial voltage signal terminal from the gate of the driving thin film transistor, the first terminal of the storage capacitor and the second terminal of coupling capacitor by the gate initial voltage writing module; connecting the data voltage signal terminal with the source of the driving thin film transistor by the data voltage writing module to write a data voltage signal into the source of the driving thin film transistor; disconnecting the source of the driving thin film transistor from the second power supply by the initializing module; disconnecting the one terminal of the organic light emitting diode from the drain of the driving thin film transistor by the light emitting control module; connecting the first terminal of the coupling capacitor with the drain of the driving thin film transistor by the saturation discharging module; and discharging the storage capacitor and the coupling capacitor through the driving thin film transistor;

in a light emitting phase:

disconnecting the initial voltage signal terminal from the gate of the driving thin film transistor, the first terminal of the storage capacitor and the second terminal of coupling capacitor by the gate initial voltage writing module; disconnecting the data voltage signal terminal from the source of the driving thin film transistor by the data voltage writing module; connecting the source of the driving thin film transistor with the second power supply by the initializing module; connecting the one terminal of the organic light emitting diode with the drain of the driving thin film transistor by the light emitting control module; disconnecting the first terminal of the coupling capacitor from the drain of the driving thin film transistor by the saturation discharging module; and providing a driving current for the organic light emitting diode by the driving thin film transistor.

18. The driving method according to claim 17, wherein the gate initial voltage writing module comprises a second thin film transistor, the data voltage writing module comprises a third thin film transistor, the saturation discharging module comprises a fourth thin film transistor, the initializing module comprises a fifth thin film transistor, and the light emitting control module comprises a sixth thin film transistor, the driving method comprising:

in the initializing phase:

turning on the second thin film transistor, the fourth thin film transistor, the fifth thin film transistor and the sixth thin film transistor, and turning off the third thin film transistor; writing the initial voltage signal into the gate of the driving thin film transistor, the first terminal of the storage capacitor and the second terminal of the coupling capacitor; charging the second terminal of the storage capacitor by the second power supply; and charging the first terminal of the coupling capacitor by the first power supply;

in the threshold voltage compensating and data voltage writing phase:

turning on the third thin film transistor and the fourth thin film transistor, and turning off the second thin film transistor, the fifth thin film transistor and the sixth thin film transistor; writing the data voltage signal into the source of the driving thin film transistor, and discharging the storage capacitor and the coupling capacitor through the driving thin film transistor;

in the light emitting phase:

turning on the fifth transistor and the sixth thin film transistor, and turning off the second thin film transistor, the third thin film transistor and the fourth thin film transistor; and providing the driving current for the light emitting diode by the driving thin film transistor.

* * * * *